US005283147A

United States Patent [19]

Johnston et al.

[11] Patent Number: 5,283,147

[45] Date of Patent: Feb. 1, 1994

[54] ELECTROSTATOGRAPHIC TONER CONTAINING MAGENTA PIGMENT

[75] Inventors: Brian H. Johnston; Thomas H. Whitesides, both of Rochester, N.Y.

[73] Assignee: Eastman Kodak Company, Rochester, N.Y.

[21] Appl. No.: 888,698

[22] Filed: May 27, 1992

[51] Int. Cl.[5] ..... G03G 9/09

[52] U.S. Cl. ..... 430/106; 430/109; 430/111

[58] Field of Search ..... 430/106, 109, 45, 111, 430/241, 225; 546/5, 6, 7

[56] References Cited

U.S. PATENT DOCUMENTS

| | | | |
|---|---|---|---|
| Re. 31,072 | 11/1982 | Jadwin et al. | 430/99 |
| 4,183,755 | 1/1980 | Chapman et al. | 430/213 |
| 4,358,404 | 11/1982 | Chapman et al. | 260/156 |
| 4,419,435 | 12/1983 | Reczek et al. | 430/223 |
| 4,521,506 | 6/1985 | Stolzenburg et al. | 430/241 |
| 4,563,409 | 1/1986 | Suzuki et al. | 430/106 |
| 4,833,060 | 5/1989 | Nair et al. | 430/137 |
| 4,965,131 | 10/1990 | Nair et al. | 428/407 |

FOREIGN PATENT DOCUMENTS

| | | |
|---|---|---|
| 62-147465 | 7/1987 | Japan . |
| 253759 | 10/1989 | Japan . |

*Primary Examiner*—Marion E. McCamish
*Assistant Examiner*—Rosemary Ashton
*Attorney, Agent, or Firm*—Willard G. Montgomery

[57] ABSTRACT

Electrostatographic toner materials containing a magenta pigment which is a metal coordination complex of a substituted 6-arylazo-3-pyridinol compound are disclosed. These pigments are formulated with fusible polymeric binders to provide a toner which exhibits excellent triboelectric properties and improved magenta color and hue when utilized in the electrostatographic process to produce colored electrophotographic images.

21 Claims, No Drawings

ELECTROSTATOGRAPHIC TONER CONTAINING MAGENTA PIGMENT

CROSS REFERENCE TO RELATED PATENT APPLICATIONS

This patent application is related to U.S. patent application Ser. No. 07/888,697 (entitled "Electrostatographic Toner Containing Cyan Pigment") and to U.S. patent application Ser. No. 07/888,696 (entitled "Electrostatographic Toner Containing Yellow Pigment") which are both being filed concurrently with the present application and which both have common inventorship and a common assignee with the present patent application.

FIELD OF THE INVENTION

This invention relates to novel toner particles containing magenta pigments, their method of preparation and the use of these materials as developer components in the preparation of colored electrophotographic images.

BACKGROUND OF THE INVENTION

In the electrophotographic process, an image comprising an electrostatic field pattern, usually of non-uniform strength (also referred to as an electrostatic latent image), is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a visible image by contacting the latent image with an electrostatographic developer. If desired, the latent image can be transferred to another surface before development.

One well known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectrical continuum, so that when they contact each other during mixing to form the developer, they become triboelectrically charged. The toner particles thus acquire a charge of one polarity and the carrier particles acquire a charge of the opposite polarity. These opposite charges attract each other such that the toner particles cling to the surfaces of the carrier particles. When the developer is brought into developing, e.g., contact, relation with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods or can be transferred to another surface to which it then can be similarly fixed.

A more recent development of the electrostatographic process is its application for the production of colored images. These systems are based on trichromatic color synthesis such as produced by subtractive color formation wherein at least three separate color separation images are formed and the combined images brought into register with each other to form a colored reproduction of a full colored original.

In accordance with such a process, a photoconductor having a uniformly charged photoconductive surface (photoreceptor) capable of forming an electrostatic latent image is exposed through a green filter to an imagewise projection of a color image to form an electrostatic latent image on the photoreceptor. This electrostatic latent image is then developed with the complementary magenta color toner to form a magenta colored image corresponding to said electrostatic latent image, and transferred in register to an image receiving member. The photoreceptor is then electrostatically charged uniformly in the dark and exposed through a red filter to an imagewise projection of a color image in register with said magenta developed image to form a second electrostatic latent image, which second image is developed with the complementary cyan color toner and likewise transferred in register. The photoconductor is again electrostatically uniformly charged in the dark and then exposed through a blue filter to an imagewise projection of a color image in register with said magenta and cyan developed images to form a third electrostatic latent image which is then developed with the complementary yellow toner and again transferred in register. The sequence of exposures through colored filters in this multiple development process may be performed in any suitable sequence other than the green, red and blue mentioned.

This combination of three color toner images is generally made on a copy sheet transfer member such as paper or clear plastic to which the toner images are permanently affixed. One of the most common techniques for fixing these toner images to the copy sheet comprises employing a fusible resin toner which includes a colorant, and heat fixing the toner images to the copy sheet. Images may also be fixed by other techniques such as, for example, subjecting them to a solvent vapor.

In most regions of the transfer member, the transferred layers are coated one on top of the other, the first layer being the magenta layer, the second being the cyan layer and the third being the yellow layer. Each substractive color transmits two thirds of the spectrum and absorbs one third. The combination of cyan, magenta and yellow layers appears black, while the combination of magenta and yellow layers appears red, the combination of magenta and cyan layers appears blue, and the combination of yellow and cyan layers appears green. Images of enhanced contrast may also be prepared using a fourth black-colored toner in combination with the cyan, magenta and yellow toners described above.

In the color process, a colorant and resin combination used to make the toner must meet a number of stringent requirements. First, the formulated colorant must be of the correct color and hue within its spectral band width with minimal response in other bands so that it works together with complementary colorants to produce faithful color reproductions. Second, a colorant and resin combination must be selected such that the toner possesses the appropriate triboelectric properties which will enable it to function and continue to function in an electrophotographic imaging mode. It is a function of the toner-carrier combination or developer package in a given development system, for example cascade, to assume a triboelectric relationship such that the toner will be carried with the carrier during the development cycle by electrostatic attraction and then be selectively deposited charge-wise on the electrostatic latent image which has a greater affinity for the toner electrostatically than does the carrier particle. In addition to the very significant triboelectric properties that a developer must possess and maintain during the development cycle, the toner must not only possess the appropriate color, but must also continue to function under machine conditions which expose the developer to impaction, humidity and oxygen among other undesirable factors. Third, the colorant used in formulating colored toner must be sufficiently color stable such that toner material of the requisite particle size, i.e., preferably from about 2 to about 20 microns, can be prepared without any significant diminution of color properties of the toner such as spectral response, color mixing characteristics and transparency. Finally, toners containing such colorants must also exhibit good transfer characteristics and the colorants preferably should have good heat and light stability.

Quite clearly, requirements must be met for the provision of colored toner materials capable of reproducing faithful electrostatographic reproductions of colored originals which are more stringent than the fact that a particular pigment used to produce the toner may be of a magenta, cyan or yellow color.

SUMMARY OF THE INVENTION

The present invention is directed to novel electrostatographic toner and developer compositions containing a magenta pigment which is based on a 1:1 coordination complex of a polyvalent metal ion and a 6-arylazo-3-pyridinol compound having the Formula 1:

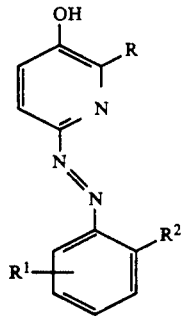

1.

wherein R is selected from the group consisting of OH; $NH_2$; and an alkyl group containing from 1 to about 6 carbon atoms;

$R^1$ is selected from the group consisting of hydrogen; an alkyl group having 1 to about 6 carbon atoms; acyl, aryl, aralkyl, alkylsulfonyl, amino, alkoxy, halogen, morpholino, phenylsulfamoyl, sulfonamido, sulfamoyl, carboxy and sulfo and hydrolyzable precursors thereof; and $R^2$ is a complex-forming substituent selected from the group consisting of COOH; a hydrolyzable ester group of the formula $COOR^3$ wherein $R^3$ is an alkyl group having from 1 to about 8 carbon atoms or an aryl group having 6 to about 10 carbon atoms; and sulfamoyl having the formula $SO_2NHR^4$ wherein $R^4$ is hydrogen, alkyl having 1 to about 8 carbon atoms, aryl having 6 to about 10 carbon atoms or carbacyl having 1 to about 8 carbon atoms.

In a more preferred embodiment, the pigment of this invention comprises a coordination complex of a polyvalent metal ion and the 6-arylazo-3-pyridinol compound of Formula 1, which complex has the structure of Formula 2:

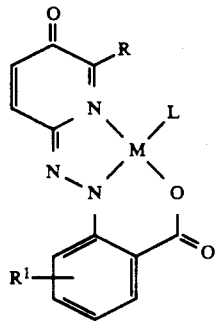

2.

wherein M is a divalent or trivalent coordinate metal ion, L is a ligand and R and $R^1$ are as set forth above.

The pigments of this invention can be readily formulated with a polymeric binder to provide toner and developer particles having a controlled and predetermined size and size distribution and excellent triboelectric properties. These toners contribute to the formation of electrostatographic color images having improved magenta color and hue with minimum unwanted absorption outside of the magenta region of the spectrum thereby enabling the production of more faithful color reproductions of colored originals or even an enhancement of such originals.

The present invention also provides a process for preparing a magenta toner composition. The process comprises a first step of dispersing a concentrate containing the magenta pigment described hereinabove and a toner polymer material into an organic solvent which dissolves said polymer material and may or may not dissolve said pigment, but which is immiscible with water to form an oil phase. A second step comprises mixing the oil phase under high shear mixing conditions with an aqueous phase containing a colloidal stabilizer to form a suspension of said oil phase in said aqueous phase. A third step comprises removing the solvent from said suspended oil phase. A fourth step comprises separating solidified particles of polymer/pigment mixture from said aqueous phase.

These and other features and advantages of the present invention will be better understood taken in conjunction with the following detailed description and claims.

DETAILED DESCRIPTION

As indicated above, the magenta pigments of the present invention are prepared by forming a metal coordination complex of a 6-arylazo-3-pyridinol compound having the structure of Formula 1. Preferred pigments are represented by the structure of Formula 2 and are based on metal complexes of Formula 1 compounds wherein $R^2$ is COOH or $COOR^3$.

The pigments may be in the form of 1:1 complexes having the structure of Formula 2 wherein L is a ligand capable of satisfying the coordination number of the metal. Preferred ligand groups include $H_2O$, Cl, ammonia, acetate or pyridine. In another embodiment, these pigments may be 2:1 complexes having the structure of Formula 2 where L is a second identical tridentate dye.

In a preferred embodiment, $R^1$ is selected from the group consisting of hydrogen; an alkyl group having 1 to about 6 carbon atoms; an alkoxy group having from 1 to 4 carbon atoms; Cl; Br; $SO_2C_6H_5$; $SO_2NHC_6H_5$; $SO_2NH_2$; and $SO_2C_6H_4X$ wherein X is $C_1$ to $C_6$ alkyl, $SO_2CH_3$, OH, $SO_2NH_2$ or $SO_2NHCH(CH_3)_2$.

M in Formula 2 above is a divalent or trivalent metal ion which will complex with azo dye moieties having the structure of Formula 1. Such metal ions include Zinc II, Nickel II, Copper II, Cobalt II, Cobalt III, Platinum II and Palladium II. Particularly good pigments are obtained where M is a divalent nickel ion.

In a more preferred embodiment of this invention, $R^1$ is positioned at the 4, 5 or 6 position in the aromatic ring, most preferably at the 4 position, and is selected from hydrogen, Cl or $C_1$ to $C_6$ alkyl, and $R^2$ is COOH. The aromatic ring should not, however, be substituted with a nitro group which would adversely shift the hue of the pigment chromatically.

The metallization reaction can be carried out in a single step process by reacting about 1 mole of a metal donating compound with about 1 mole of the appropriate azo compound to yield 1:1 complexes having the structure of Formula 2, or by reacting about 1 mole of the metal donating compound with about 2 moles of the appropriate azo compound to yield 2:1 complexes having the structure of Formula 2 where L is an azo dye moiety. Suitable metal donating compounds which may be used as the source of metal ions are metal salts including sulfates, acetates, nitrates and halides as well as complex salts such as metal amine salts or metal alkali salts of carboxylic acids or amino acids. The reaction takes place in a suitable solvent medium, for example, water, lower alkyl alcohol, formamide, glycol ethers, pyridine and the like, the choice of solvent being a function of the solubility of the reactants therein. Reaction temperatures may range from about 20° C. up to about 100° C. depending upon the ease of metallization of the particular diazo starting compound.

Monoazo dyes having the structure of Formula 1 may be prepared by generally well known diazotization and coupling methods using the appropriate reactants. The preferred method involves the diazotization of the aromatic compound, e.g., a 2-aminobenzoic acid, using a mineral acid such as hydrochloric acid or trifluoroacetic acid and a source of nitrous acid such as sodium nitrite or isopentylnitrite. The subsequent coupling of the diazonium salt with the appropriate 3-pyridinol compound, e.g., 2-substituted-3-hydroxypyridine, is then carried out according to known methods in an acid to alkaline medium and at temperatures generally below about 10° C.

The most preferred magenta pigments for use in manufacturing the toner and developer compositions of this invention are 1:1 compounds of Formula 2 above wherein R is $CH_3$, $R^1$ is hydrogen or Cl, M is divalent nickel and L is ammonia or $H_2O$. These compounds generally absorb within the spectral range of from about 500–600 nm.

These and other dyes and dye complexes which may be used as precursor materials for the preparation of pigment in accordance with this invention are analogous to those disclosed in U.S. Pat. No. 4,358,404, the complete disclosure of which is incorporated herein by reference.

Toner materials may be prepared in accordance with this invention by combining the pigment with a suitable polymer binder material such that the toner contains from about 2 to about 20% by weight of the pigment, more preferably from about 1 to 10% by weight, most preferably about 5% by weight.

The toner particles can comprise any fixable polymer which has the physical properties required for a dry electrostatographic toner. By fixable is meant simply that the toner particles can be fixed or adhered to a receiving sheet such as paper or plastic. Useful toners are often thermally fusible and fixable to the receiving sheet. However, toners which are otherwise fixable, such as solvent-fixable, pressure-fixable or self-fixable, can be prepared in accordance with the invention. These fixing techniques and toners suitable for them are well-known in the art.

Suitable polymers which may be used as binder materials in toners include, for example, olefin homopolymers and copolymers, such as polyethylene, polypropylene, polyisobutylene, and polyisopentylene; polyfluoroolefins such as polytetrafluoroethylene; polyamides such as polyhexamethylene adipamide, polyhexamethylene sebacamide and polycaprolactam; acrylic resins, such as polymethylmethacrylate, polyacrylonitrile, polymethylacrylate, polyethylmethacrylate and styrene-methylmethacrylate or ethylene-methyl acrylate copolymers, ethylene-methyl acrylate copolymers, ethylene-ethyl methacrylate copolymers, polystyrene and copolymers of styrene with unsaturated monomers mentioned above; cellulose derivatives, such as cellulose acetate, cellulose acetate butyrate, cellulose propionate, cellulose acetate propionate and ethyl cellulose; polyesters; polycarbonates; polyvinyl resins such as polyvinyl chloride and polyvinyl acetate, polyvinyl butyral, polyvinyl alcohol, polyvinyl acetal, ethylene-vinyl acetate copolymers, ethylene-vinyl alcohol copolymers and ethylene-allyl copolymers such as ethylene-allyl alcohol copolymers, ethylene-allyl acetone copolymers, ethylene-allyl benzene copolymers, ethylene-allyl ether copolymers, ethylene-acrylic copolymers; and polyoxymethylene.

More preferred polymers for use as binder materials in toners include vinyl polymers, such as homopolymers and copolymers of styrene and condensation polymers such as polyesters and copolyesters. Especially useful toners are styrene polymers of from 40 to 100 percent by weight of styrene or styrene homologs and from 0 to 60 percent by weight of one or more lower alkyl acrylates or methacrylates. Fusible styrene-acrylic copolymers which are covalently lightly cross-linked with a divinyl compound such as divinylbenzene are useful, such as disclosed in Jadwin et al. U.S. Pat. No. Re. 31,072. Also especially useful are polyesters of aromatic dicarboxylic acids with one or more aliphatic diols, such as polyesters of isophthalic or terephthalic acid with diols such as ethylene glycol, cyclohexane dimethanol and bisphenols. Examples are disclosed in the above mentioned patent to Jadwin et al.

Fusible toner particles prepared according to this invention can have fusing temperatures in the range from about 50° C. to 200° C. so they can readily be fused to paper receiving sheets. Preferred toners fuse in the range of from about 65° C. to 120° C. If the toner transfer is made to receiving sheets which can withstand higher temperatures, polymers of higher fusing temperatures can be used.

Toner particles having the requisite particle size of about 0.1 to about 100 microns, more preferably from about 1 to about 30 microns, most preferably from about 2 to about 20 microns, can be prepared by techniques known in the art such as by hot melting a mixture of binder resin, pigment and any other addenda included in the composition, and grinding and screening the resultant bulk polymer composition. Other known techniques involve the suspension polymerization of monomers used to make the toner binder mixed with colorant and recovery of the suspended polymer particles, or the solvent/non-solvent method wherein a polymer and colorant are dissolved in solvent and the polymer/colorant mixture is caused to precipitate from the solvent by the addition of another solvent which is miscible with the first solvent but in which the polymer phase is non-soluble.

A particular advantage of the pigments of this invention is that they can be formulated into toner materials using evaporative limited coalescence procedures analogous to those disclosed in U.S. Pat. Nos. 4,833,060, 4,835,084 and 4,965,131, the complete disclosure of which patents is incorporated herein by reference. These processes provide toner particles of the requisite size and also of very narrow particle size distribution which is a very important characteristic for toner used in color electrophotography.

In accordance with a preferred procedure known as the polymer suspension method, a melt color concentrate may first be formed by hot milling an approximately 1:1 mixture of pigment and relatively high glass transition temperature polymer material, optionally containing minor quantities of a wax material. This mixture forms a brittle pigment concentrate upon cooling. This concentrate and additional binder polymer are then dissolved in a suitable solvent to form an oil phase. If the pigment is not completely soluble in the oil phase, the oil phase may also contain a suspension stabilizer to keep the pigment in suspension as it disperses in the oil phase.

Instead of first forming a pigment concentrate as described above, pigment particles can be simply ball milled with an organic solvent which also contains a minor amount of a pigment suspension stabilizer to form a pigment concentrate suspension, and this suspension may then be combined with binder polymer and additional solvent to form the oil phase.

Useful solvents for use in preparing the oil phase include those that dissolve the polymer and which are also immiscible with water including, for example, chloromethane, dichloromethane, ethyl acetate, vinyl chlomethane, vinyl chloride, methyl ethyl ketone, trichloromethane, carbon tetrachloride, ethylene chloride, trichloroethane, toluene, xylene, cycohexanone, 2-nitropropane and the like.

The concentration of the polymer components in the solution may generally range from about 5 to about 30% by weight and the concentration of the pigment generally ranges from about 2 to about 15% by weight.

This solution is then introduced under high shear mixing conditions into an aqueous solution containing a solid colloidal stabilizing agent which may be finely divided silica as disclosed U.S. Pat. No. 4,833,060, or which may be a finely divided suspension of an interpolymer of styrene, 2-hydroxyethyl methacrylate, methacrylic acid, ethylene dimethacrylate, and optionally butyl methacrylate as disclosed in U.S. Pat. No. 4,965,131. The solvent is then caused to evaporate by heating the mixture under agitation, during which time the stabilizer present in the aqueous phase tends to limit the coalescence of the suspended polymer particles as they precipitate from the aqueous phase, thereby resulting in colored toner particles having the requisite particle size distribution.

The quantities of the various ingredients and their relationship to each other can vary over wide ranges. It has generally been found that the ratio of the polymer to the solvent should vary in an amount of from about 1 to about 80 percent by weight of combined weight of polymer and solvent and that the combined weight of the polymer in the solvent should vary with respect to the quantity of water employed in an amount of from about 25 to about 50 percent by weight. Also the size and quantity of the solid colloidal stabilizer depends upon the size of the particles of the stabilizer and also upon the size of the polymer particles desired. Thus, as the size of the polymer/solvent droplets are made smaller by high shear agitation, the quantity of solid colloidal stabilizer is varied to prevent uncontrolled coalescence of the droplets in order to achieve uniform size and narrow size distribution in the polymer particles that result.

Polymer particles having average diameters in the range of about 0.1 microns to about 100 microns, often from about 2 microns to about 20 microns can be prepared in accordance with the process of this invention. Such particles have a very narrow size distribution. Their coefficients of variation (ratio of the standard deviation to the average diameter) are normally in the range of about 15 to 35%.

Toner particles prepared in accordance with this invention can simply comprise the colored polymeric particles, but it is often desirable to incorporate addenda in the toner such as waxes, release agents, charge control agents and other toner addenda well known in the art.

Charge control agents suitable for use in toners are disclosed, for example, in U.S. Pat. Nos. 3,893,935; 4,079,014; 4,323,634; 4,812,381 and 5,075,190, as well as British Patent Nos. 1,501,065 and 1,420,839. Charge control agents are generally employed in small quantities such as from about 0.1 to about 3 weight percent, and preferably from about 0.2 to about 1.5 weight percent, based on the weight of the toner.

Toners prepared in accordance with this invention can be mixed with a carrier. The carriers which can be used to form suitable developer compositions can be selected from a variety of materials. Such materials include carrier core particles and core particles overcoated with a thin layer of film-forming resin.

The carrier core materials can comprise conductive, non-conductive, magnetic, or non-magnetic materials, such as disclosed for example, in U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, including ferrites of barium, strontium, lead, magnesium, or aluminum. Such materials are disclosed in, U.S. Pat. Nos. 4,042,518, 4,478,925 and 4,546,060.

As noted above, the carrier particles can be overcoated with a thin layer of a film-forming resin for the purpose of establishing the correct triboelectric relationship and charge level with the toner employed. Examples of suitable resins are described in U.S. Pat. Nos. 3,547,822; 3,632,512; 3,795,618; 3,898,170; 4,545,060; 4,478,925; 4,076,857; and 3,970,571.

A typical developer composition containing the above-described toner and a carrier vehicle generally comprises from about 1 to 20 percent by weight of particulate toner particles and from about 80 to about 99 percent by weight of carrier particles. Usually, the carrier particles are larger than the toner particles. Conventional carrier particles have a particle size on the order of from about 20 to about 1200 microns, generally about 30–300 microns.

Alternatively, the toners of the present invention can be used in a single component developer, i.e., with no carrier particles such as a toner comprising non-magnetic, insulative toner particles of an insulating binder resin as matrix containing the above described magenta pigment and optionally a charge control agent.

As stated above, the magenta toner prepared in accordance with this invention is adapted for use in a full color electrostatographic process along with complementary cyan, yellow and, optionally, black toners.

Illustrative of cyan toners are those containing copper tetra-4-octadecylsulfonamide-phthalocyanine, an x-copper phthalocyanine pigment listed in the Color Index as Cl 74160, CI Pigment Blue 15; an indantherene blue identified in the Color Index as CI 69810, Special Blue 2137; and like known cyan materials. Especially preferred cyan toners are those based on the 6-heterocycloazo-3-pyridinol pigments as disclosed in applicant's copending application Ser. No. 07/888,697, filed in the U.S. Patent and Trademark Office on even date herewith and entitled "Electrostatographic Toner Containing Cyan Pigment".

Illustrative of yellow toners include those containing permanent yellow FGL, Color Index Pigment Yellow 97, one of the preferred yellow materials which is prepared commercially by diazotization of 2,5 dimethoxy aniline-4-sulfonanilide, followed by coupling with 4-chloro-2,5 dimethoxy-acetanilide; diarylide yellow 3,3-dichlorobenzidene aceto-acetanilide, a monoazo dye identified in the Color Index as CI 12700, CI Solvent Yellow 16; a nitrophenylaminesulfonamide identified in the Color Index as Foron Yellow Se-GLF, CI Dispersed Yellow 33; and the like. Especially preferred yellow toners are those based on the yellow diazo pigments as disclosed in applicant's copending application Ser. No. 07/888,696, filed in the U.S. Patent and Trademark Office on even date herewith and entitled "Electrostatographic Toner Containing Yellow Pigment".

Carbon black provides a particularly useful colorant for the optional black toner.

Carbon black provides a particularly useful colorant for the optional black toner. The black toner may be a non-magnetic toner used as a monocomponent developer, or it may be a magnetic toner, e.g., containing magnetic material, or it may be used in the form of a two component magnetic developer with associated carrier particles.

The following examples are illustrative of the invention:

EXAMPLE 1

This example describes the preparation of a representative pigment complex based on a monazo dyestuff having the structure of Formula 1 above, wherein R is $CH_3$, $R^1$ is para-chloro and $R^2$ is COOH, is first prepared and then complexed with divalent nickel to yield a coordination complex having the structure of Formula 2 wherein R is $CH_3$ and $R^1$ is para-chloro.

a) Diazotization/Coupling Reaction

2-Amino-5-chlorobenzoic acid (10.1 g, 73.7 mmol) was added to a solution of sodium hydroxide (3.0 g, 75 mmol) in water (75 ml) and stirred until dissolved. Sodium nitrite (5.1 g, 73.9 mmol) was added and the resulting mixture was cooled to 0° C. and added to a mixture of concentrated hydrochloric acid (25 ml) and ice (200 g). This mixture was added dropwise to a solution of 2-methyl-3-hydroxypyridine (8 g, 73.3 mmol) and sodium carbonate (59.5 g, 56.1 mmol) in water (400 ml) at 0° C. The mixture was then stirred at room temperature for one hour and then brought to pH 6 by addition of concentrated hydrochloric acid. A precipitate was deposited and removed by filtration affording 18 g of the azo dye.

b) Formation of Metal Complex

The azo dye prepared in part (a) above (15.0 g, 17 mmol) and nickel nitrate hexahydrate (15.1 g, 51.9 mmol) were added to warm methanol (3000 ml) in a 5000 ml beaker. After 1 hour, 10% ammonium hydroxide solution (14 ml) was added and the solution was stirred for 12 hours. Any undissolved material was removed by filtration and the filtrate was concentrated under reduced pressure to afford the magenta pigment in quantitative yield.

EXAMPLE 2

This example describes a method for preparing colored toner particles using the magenta pigment prepared in Example 1 as a colorant.

a) Preparation of Pigment Concentrate.

A melt concentrate was prepared by mixing on a two roll mill at about 130° C. a 1:1 mixture of a finely ground pigment prepared according to Example 1 and a high molecular weight copolymer of styrene and butyl acrylate marketed by Goodyear under the trade designation PLIOTONE 4003. The concentrate composition also contained about 5% by weight of a hydroxy-terminated polyethylene wax added as a plasticizer. After cooling, the mass was comminuted to provide brittle chunks of pigment concentrate.

b) Preparation of Pigment Oil Phase.

To 14.3 g of ethyl acetate were added 6.3 g of the concentrate prepared in part (a) above. This mixture was stirred until the polymer was dissolved. While stirring, 4.4 g of a styrene/butyl acrylate addition copolymer (sold by Hercules as PICCOTONER 1221) and 0.012 g of tetradecylpyridinium tetraphenylborate (charge control agent) were added and stirring continued until the added components were uniformly dispersed or dissolved in the solvent.

c) Preparation of Toner.

24 g of the pigment oil phase prepared in part (b) above was dispersed using a high shear mixer into 119 ml of an aqueous pH 10 buffer solution also containing 2 grams of a latex suspension of a sub-micron size colloidal stabilizer based on an interpolymer of 8% by weight of styrene, 50% by weight of butyl methacrylate, 30% by weight of 2-hydroxyethyl methacrylate, 5% by weight of methacrylic acid and 7% by weight of ethyl dimethacrylate.

The aqueous phase and organic phase were then homogenized using a Microfluidics Model M110F operating at 8100 psig. After homogenization, the ethyl acetate was removed by evaporation under a nitrogen stream with gentle mechanical stirring.

Coarse material was removed by filtration through a 50 micron screen and the toner particles were isolated by vacuum filtration. The toner particles were then washed thoroughly with distilled water and dried. The particles had an average particle diameter of about 6 microns with a particle size distribution range of about 2 to 10 microns.

EXAMPLE 3

This example illustrates an alternative process for preparing colored toner particles using pigment of Example 1 as a colorant wherein the pigment oil phase is prepared without first forming a polymer-containing concentrate as in Example 2.

10 g of the pigment of Example 1, 2 g of a pigment dispersant (marketed as ELVACITE ™ AB1010 by Du Pont Corporation) and 100 g of ethyl acetate were mixed using a ball-mill until a fine suspension of the pigment in the solvent was obtained. 6.6 g of this suspension, 4.4 g of PICCOTONER 1221 binder and 0.012 g of tetradecylpyridinium tetraphenylborate charge agent were added to an additional 13.9 g of ethyl acetate and the mixture was stirred until the polymer and charge agent were dissolved.

Toner was then prepared by the polymer suspension process by dispersing 24.0 g of this oil phase into an aqueous phase exactly as set forth in part (c) of Example 2.

EXAMPLE 4

The toner material prepared in Example 3 was formulated into an electrostatographic developer as follows: 6 parts by weight of the toner particles of Example 3 were mixed with 94 parts by weight of a hard ferrite carrier coated with 1 pph of polyvinylidene fluoride and the mixture was shaken in a jar. The triboelectric properties of the toner were then evaluated on a magnetic brush development system. The initial positive triboelectric charge (charge-to-mass of toner) on the brush was measured at +60 microcoulombs per gram of toner. After 5 minutes of exercise on the brush, the charge was +25 microcoulombs per gram of toner.

The toner was transferred to a receiver sheet using a 300 volt bias at 22.8% relative humidity (RH). After heat fusing on the receiver, the transferred toner had a visible magenta spectrum which showed maximum absorbance at 556 nm.

Similar magenta pigments according to Formula 1 and Formula 2 are obtainable with analogous starting materials which may be formed into magenta toners, in accordance with the applicable procedures illustrated in Examples 1 through 4 hereinabove.

While the invention has been described in detail with reference to certain preferred embodiments, it will be understood that variations may be made by those skilled in the art without departing from the spirit and scope of the invention.

What is claimed is:

1. A dry, particulate electrostatographic toner composition comprising a binder polymer having mixed therewith a magenta pigment which is a coordination complex of a divalent or trivalent metal ion and a 6-arylazo-3-pyridinol compound having the structure:

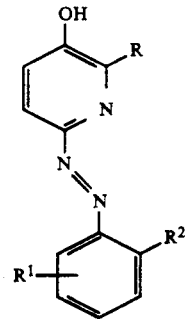

wherein

R is selected from the group consisting of OH; $NH_2$; and an alkyl group containing from 1 to about 6 carbon atoms;

$R^1$ is selected from the group consisting of hydrogen; an alkyl group having 1 to about 6 carbon atoms; acyl; aryl; aralkyl; alkylsulfonyl; amino; alkoxy; halogen; morpholino; phenylsulfamoyl; sulfonamido; sulfamoyl; carboxy and sulfo; and hydrolyzable precursors thereof; and $R^2$ is a complex-forming substituent selected from the group consisting of COOH; a hydrolyzable ester group of the formula $COOR^3$ wherein $R^3$ is an alkyl group having from 1 to about 8 carbon atoms or an aryl group having 6 to about 10 carbon atoms; and sulfamoyl having the formula $SO_2NHR^4$ wherein $R^4$ is hydrogen, alkyl having 1 to about 8 carbon atoms, aryl having 6 to about 10 carbon atoms or carbacyl having 1 to about 8 carbon atoms;

said toner having an average particle size within the range of from about 0.1 to about 100 microns.

2. The toner composition of claim 1 wherein $R^1$ is selected from the group consisting of hydrogen; an alkyl group having 1 to about 6 carbon atoms; an alkoxy group having from 1 to 4 carbon atoms; Cl; Br; $SO_2C_6H_5$; $SO_2NHC_6H_5$; $SO_2NH_2$; and $SO_2C_6H_4X$ wherein X is $C_1$ to $C_6$ alkyl, $SO_2CH_3$, OH, $SO_2NH_2$ or $SO_2NHCH(CH_3)_2$.

3. The toner composition of claim 2 wherein $R^1$ is positioned at the 4, 5 or 6 ring position and is selected from the group consisting of hydrogen, chloro or $C_1$ to $C_6$ alkyl.

4. The toner composition of claim 3 wherein $R^1$ is 4-chloro.

5. The toner composition of claim 1 wherein $R^2$ is COOH.

6. The toner composition of claim 1 wherein R is $CH_3$.

7. The toner composition of claim 1 wherein said metal ion is selected from the group consisting of zinc II, nickel II, copper II, cobalt II, cobalt III, platinum II and palladium II.

8. The toner composition of claim 7 wherein said metal ion is divalent nickel.

9. The toner composition of claim 1 wherein said coordination complex has the structure:

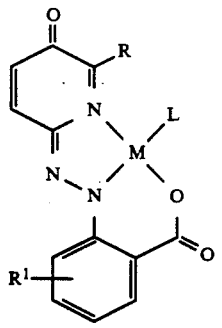

wherein R and $R^1$ are as set forth, M is a divalent or trivalent coordinate metal ion and L is a ligand.

10. The toner composition of claim 9 wherein $R^1$ is positioned at the 4, 5 or 6 ring position and is selected from the group consisting of hydrogen, chloro or $C_1$ to $C_6$ alkyl.

11. The toner composition of claim 10 wherein $R^1$ is 4-chloro.

12. The toner composition of claim 9 wherein R is $CH_3$.

13. The toner composition of claim 9 wherein M is selected from the group consisting of zinc II, nickel II, copper II, cobalt II, cobalt III, platinum II and palladium II.

14. The toner composition of claim 12 wherein M is divalent nickel.

15. The toner composition of claim 9 wherein L is selected from the group consisting of $H_2O$, Cl, ammonia, acetate, pyridine and a second identical azo dye molecule.

16. The toner composition of claim 15 wherein L is $H_2O$ or ammonia.

17. The toner composition of claim 9 wherein R is $CH_3$, $R^1$ is 4-chloro and M is divalent nickel.

18. The toner composition of claim 1 containing from about 2 to about 20% by weight of said pigment.

19. The toner composition of claim 18 wherein said binder polymer is a copolymer of styrene with up to 60% by weight of one or more lower alkyl acrylates or methacrylates.

20. The toner composition of claim 18 where said toner has an average particle size within the range of about 2 to about 20 microns.

21. A developer composition comprising a mixture of carrier particles and from about 1 to about 20% by weight of the toner composition of claim 1.

* * * * *